US009238956B2

(12) United States Patent
Martinez

(10) Patent No.: US 9,238,956 B2
(45) Date of Patent: Jan. 19, 2016

(54) PERFORATING GUN APPARATUS FOR GENERATING PERFORATIONS HAVING VARIABLE PENETRATION PROFILES

(71) Applicant: Halliburton Energy Services, Inc., Houston, TX (US)

(72) Inventor: Samuel Martinez, Cedar Hill, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/268,229

(22) Filed: May 2, 2014

(65) Prior Publication Data

US 2014/0331852 A1 Nov. 13, 2014

(51) Int. Cl.

| | |
|---|---|
| ***E21B 43/11*** | (2006.01) |
| ***F42B 1/028*** | (2006.01) |
| ***E21B 43/117*** | (2006.01) |

(52) U.S. Cl.

CPC ..... *E21B 43/117* (2013.01)

(58) Field of Classification Search

USPC ..... 102/306–312, 476; 89/1.15

See application file for complete search history.

(56) References Cited

U.S. PATENT DOCUMENTS

| | | | | | |
|---|---|---|---|---|---|
| 2,873,676 | A | * | 2/1959 | Caldwell | 175/4.6 |
| 3,951,218 | A | * | 4/1976 | Sjogren | 175/4.6 |
| 4,071,096 | A | | 1/1978 | Dines | |
| 4,191,265 | A | * | 3/1980 | Bosse-Platiere | 175/4.56 |
| 4,193,460 | A | * | 3/1980 | Gilbert | 175/4.6 |
| 4,773,299 | A | * | 9/1988 | Oestreich et al. | 89/1.15 |
| 4,919,050 | A | * | 4/1990 | Dobrinski et al. | 102/307 |
| H1216 | H | * | 8/1993 | Vigil et al. | 102/306 |
| 5,792,977 | A | * | 8/1998 | Chawla | 102/307 |
| 5,936,184 | A | * | 8/1999 | Majerus et al. | 89/1.13 |
| 6,014,933 | A | * | 1/2000 | Umphries et al. | 102/312 |
| 6,460,463 | B1 | * | 10/2002 | Parrott et al. | 102/312 |
| 6,523,474 | B2 | | 2/2003 | Parrott et al. | |
| 6,702,039 | B2 | | 3/2004 | Parrott et al. | |
| 6,865,792 | B2 | | 3/2005 | Kash | |
| 6,941,871 | B2 | * | 9/2005 | Mauldin | 102/323 |
| 7,418,905 | B2 | * | 9/2008 | Bootes et al. | 102/476 |
| 7,770,662 | B2 | * | 8/2010 | Harvey et al. | 175/4.6 |
| 7,950,328 | B2 | * | 5/2011 | Howerton | 102/319 |
| 8,327,746 | B2 | * | 12/2012 | Behrmann et al. | 89/1.15 |
| 8,459,186 | B2 | * | 6/2013 | Wang et al. | 102/307 |
| 8,763,532 | B2 | * | 7/2014 | Wang et al. | 102/307 |
| 2002/0017214 | A1 | * | 2/2002 | Jacoby et al. | 102/307 |
| 2002/0134585 | A1 | | 9/2002 | Walker | |
| 2002/0162474 | A1 | | 11/2002 | Pratt et al. | |
| 2002/0189483 | A1 | | 12/2002 | Parrott et al. | |

(Continued)

OTHER PUBLICATIONS

ISRWO; PCT/US2013/040296; KIPO; 2014.

*Primary Examiner* — Michael David

(57) ABSTRACT

A perforating gun apparatus includes a carrier gun body having a plurality of jet target regions. A first set of the jet target regions has a first resistance to jet penetration and a second set of the jet target regions has a second resistance to jet penetration. A charge holder is positioned within the carrier gun body. A plurality of shaped charges is supported by the charge holder. A first set of the shaped charges is oriented to have discharge ends aligned with the first set of the jet target regions and a second set of the shaped charges is oriented to have discharge ends aligned with the second set of the jet target regions such that firing the first set of the shaped charges creates perforations having a first penetration profile and firing the second set of the shaped charges creates perforations having a second penetration profile.

21 Claims, 5 Drawing Sheets

(56) References Cited

U.S. PATENT DOCUMENTS

| | | | | |
|---|---|---|---|---|
| 2003/0037692 | A1* | 2/2003 | Liu | 102/301 |
| 2003/0131749 | A1* | 7/2003 | Lussier | 102/306 |
| 2003/0183113 | A1* | 10/2003 | Barlow et al. | 102/476 |
| 2004/0200377 | A1* | 10/2004 | Collins et al. | 102/476 |
| 2005/0115441 | A1* | 6/2005 | Mauldin | 102/306 |
| 2005/0188878 | A1* | 9/2005 | Baker et al. | 102/306 |
| 2007/0158109 | A1* | 7/2007 | Zazovsky et al. | 175/4.6 |
| 2007/0214991 | A1* | 9/2007 | Ronn et al. | 102/306 |
| 2009/0255433 | A1* | 10/2009 | Wang et al. | 102/307 |
| 2010/0269676 | A1* | 10/2010 | Behrmann et al. | 89/1.15 |
| 2010/0300750 | A1 | 12/2010 | Hales et al. | |
| 2011/0000669 | A1 | 1/2011 | Barlow et al. | |
| 2014/0053715 | A1 | 2/2014 | Zhang et al. | |

* cited by examiner

PERFORATING GUN APPARATUS FOR GENERATING PERFORATIONS HAVING VARIABLE PENETRATION PROFILES

CROSS-REFERENCE TO RELATED APPLICATIONS

This application claims the benefit under 35 U.S.C. §119 of the filing date of International Application No. PCT/US2013/040296, filed May 9, 2013.

TECHNICAL FIELD OF THE INVENTION

This invention relates, in general, to equipment utilized and operations performed in conjunction with completing a subterranean well for hydrocarbon fluid production and, in particular, to a shaped charge perforating gun apparatus for generating perforations having variable penetration profiles.

BACKGROUND OF THE INVENTION

Without limiting the scope of the present invention, its background will be described with reference to perforating a hydrocarbon bearing subterranean formation with a shaped charge perforating gun apparatus, as an example. After drilling a section of a subterranean wellbore that traverses a hydrocarbon bearing subterranean formation, individual lengths of metal tubulars are typically secured together to form a casing string that is positioned within the wellbore. This casing string increases the integrity of the wellbore and provides a path through which fluids from the formation may be produced to the surface. Conventionally, the casing string is cemented within the wellbore. To produce fluids into the casing string or to place addition cement behind the casing string, hydraulic openings or perforations must be made through the casing string and a distance into the formation.

Typically, these perforations are created by detonating a series of shaped charges located within one or more perforating guns that are deployed within the casing string to a position adjacent to the desired location. Conventionally, the perforating guns are formed from a closed, fluid-tight hollow carrier gun body adapted to be lowered into the wellbore on a conveyance such as wireline, coiled tubing, jointed tubing or the like. Disposed within the hollow carrier gun body is a charge holder that supports and positions the shaped charges in a selected spatial distribution. The shaped charges have conically constrained explosive material therein. A detonating cord that is used to detonate the shaped charges is positioned adjacent to the initiation ends of the shaped charges. The detonating cord can be activated electronically or mechanically when it is desired to firing the perforating guns.

In such closed, fluid-tight type gun bodies, the explosive jets produced upon detonation of the shaped charges must penetrate the hollow carrier gun body before penetrating the casing wall of the wellbore and the adjacent formation. To reduce the resistance produced by the hollow carrier gun body and increase the depth of perforation penetration into the formation, the perforating gun body may be provided with scallops or other radially reduced sections at the target regions through which the explosive jets pass. As such, the scallops in the hollow carrier gun body must be positioned in a spatial distribution that aligns with or corresponds to the spatial distribution of the shaped charges held within the gun body by the charge holder.

Once the perforating guns are deployed to the desired location, firing a conventional perforating gun results in perforations into the formation having substantially the same depth and entry hole dimensions. It has been found, however, that in certain operations, it may be desirable to generate perforations that do not have substantially the same depth and entry hole dimensions. A need has therefore arisen for a perforating gun apparatus that is operable to generate perforations having variable penetration profiles.

SUMMARY OF THE INVENTION

The present invention disclosed herein comprises a perforating gun apparatus operable to form perforations through the casing string and a distance into the formation. The perforating apparatus of the present invention is also operable to generate perforations having variable penetration profiles.

In one aspect, the present invention is directed to a perforating gun apparatus. The perforating gun apparatus includes a carrier gun body having a plurality of jet target regions. A first set of the jet target regions has a first resistance to jet penetration and a second set of the jet target regions has a second resistance to jet penetration. A charge holder is positioned within the carrier gun body. A plurality of shaped charges is supported by the charge holder. A first set of shaped charges is oriented to have discharge ends aligned with the first set of the jet target regions and a second set of shaped charges is oriented to have discharge ends aligned with the second set of the jet target regions such that firing the first set of shaped charges creates perforations having a first penetration profile and firing the second set of shaped charges creates perforations having a second penetration profile that is different from the first penetration profile.

In one embodiment, the first set of the jet target regions may have recesses of a first depth and the second set of the jet target regions may have recesses of a second depth. In this embodiment, the first depth may be at least 25 percent greater than the second depth. Alternatively, the first depth may be at least 50 percent greater than the second depth. In another embodiment, the first set of the jet target regions may have recesses including an insert of a first thickness and the second set of the jet target regions may have recesses including an insert of a second thickness. In this embodiment, the first thickness may be at least 50 percent greater than the second thickness. Alternatively, the first thickness may be at least 100 percent greater than the second thickness.

In a further embodiment, the first set of the jet target regions may have recesses including an insert of a first material and the second set of the jet target regions may have recesses including an insert of a second material. In this embodiment, the first material and the second material may be selected from the group consisting of ceramics, carbides, titanium and iron based alloys. The alloying constituents of the iron based alloys may be selected from the group consisting of boron, carbon, chromium, manganese, molybdenum, nickel, niobium, silicon, tungsten and vanadium. In the embodiments including inserts, the inserts may be coupled to the carrier gun body by a process selected from the group consisting of threading, brazing, adhering, thermal spraying and welding. In certain embodiments, the first penetration profile may include perforations having a greater depth than the second penetration profile. In other embodiments, the first penetration profile may include perforations having a greater entry hole diameter than the second penetration profile.

In another aspect, the present invention is directed to a perforating gun apparatus. The perforating gun apparatus includes a carrier gun body having a plurality of jet target regions. A first set of the jet target regions has recesses of a first depth that provide a first resistance to jet penetration and a second set of the jet target regions has recesses of a second depth that provide a second resistance to jet penetration. A charge holder is positioned within the carrier gun body. A plurality of shaped charges is supported by the charge holder. A first set of shaped charges is oriented to have discharge ends aligned with the first set of the jet target regions and a second set of shaped charges is oriented to have discharge ends aligned with the second set of the jet target regions such that firing the first set of shaped charges creates perforations having a first penetration profile and firing the second set of shaped charges creates perforations having a second penetration profile that is different from the first penetration profile.

In a further aspect, the present invention is directed to a perforating gun apparatus. The perforating gun apparatus includes a carrier gun body having a plurality of jet target regions. A first set of the jet target regions has recesses including an insert of a first thickness providing a first resistance to jet penetration and a second set of the jet target regions has recesses including an insert of a second thickness providing a second resistance to jet penetration. A charge holder is positioned within the carrier gun body. A plurality of shaped charges is supported by the charge holder. A first set of shaped charges is oriented to have discharge ends aligned with the first set of the jet target regions and a second set of shaped charges is oriented to have discharge ends aligned with the second set of the jet target regions such that firing the first set of shaped charges creates perforations having a first penetration profile and firing the second set of shaped charges creates perforations having a second penetration profile that is different from the first penetration profile.

In a yet another aspect, the present invention is directed to a perforating gun apparatus. The perforating gun apparatus includes a carrier gun body having a plurality of jet target regions. A first set of the jet target regions has recesses including an insert of a first material providing a first resistance to jet penetration and a second set of the jet target regions has recesses including an insert of a second material providing a second resistance to jet penetration. A charge holder is positioned within the carrier gun body. A plurality of shaped charges is supported by the charge holder. A first set of shaped charges is oriented to have discharge ends aligned with the first set of the jet target regions and a second set of shaped charges is oriented to have discharge ends aligned with the second set of the jet target regions such that firing the first set of shaped charges creates perforations having a first penetration profile and firing the second set of shaped charges creates perforations having a second penetration profile that is different from the first penetration profile.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
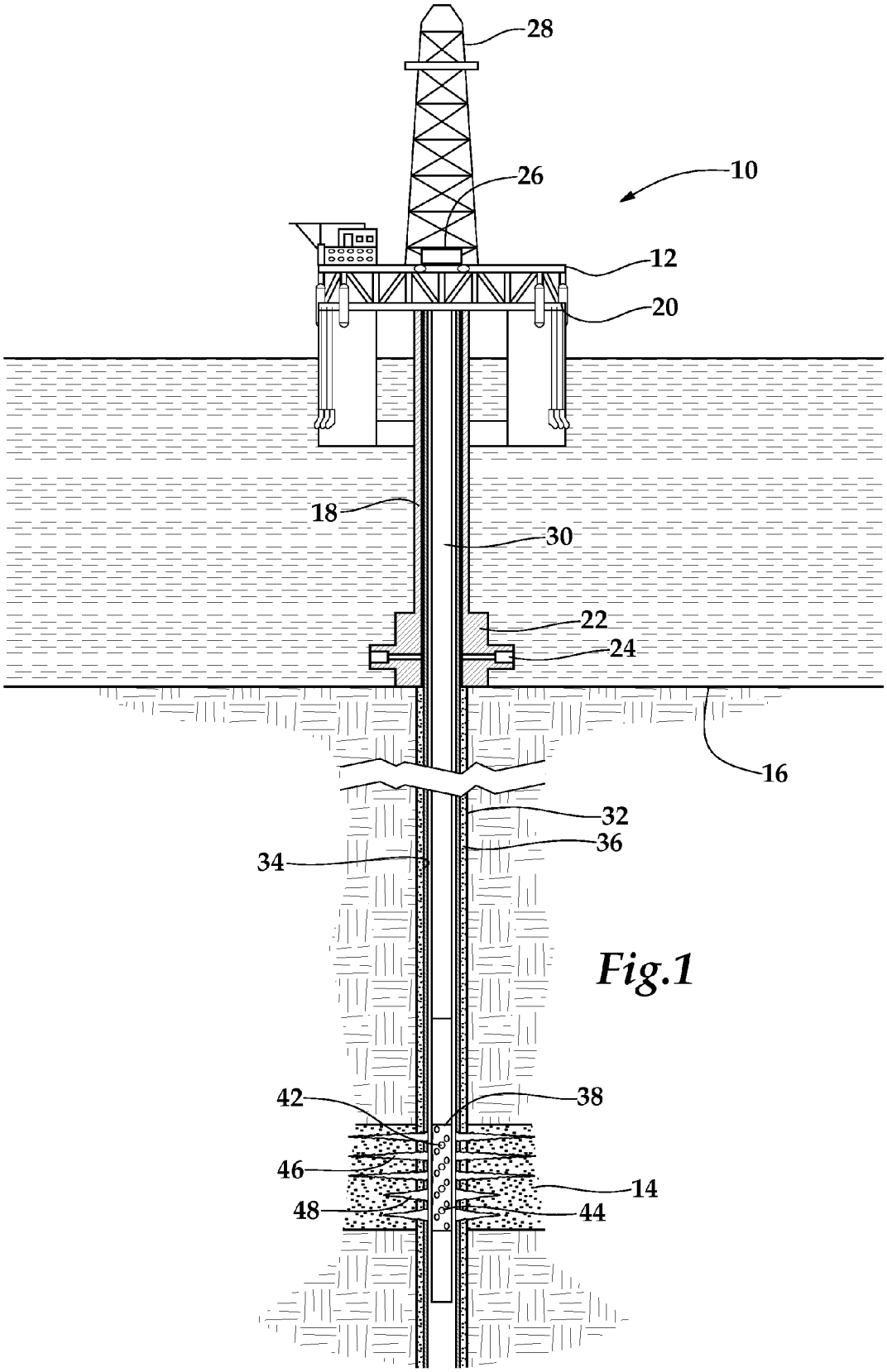
FIG. 1 is a schematic illustration of an offshore oil and gas platform operating a perforating gun apparatus according to an embodiment of the present invention.

Referring initially to FIG. 1, a perforating gun apparatus of the present invention is being operated from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools including shaped charge perforating gun apparatus 38 that is operable to generate perforations having variable penetration profiles. When it is desired to perforate the wellbore proximate formation 14, work string 30 is lowered through casing 34 until shaped charge perforating gun apparatus 38 is positioned adjacent to formation 14. Thereafter, shaped charge perforating gun apparatus 38 is fired such that the shaped charges form high speed jets that penetrate jet target regions of a carrier gun body 40 of perforating gun apparatus 38. In the illustrated embodiment, a first set of the jet target regions 42 has a first resistance to jet penetration and a second set of the jet target regions 44 has a second resistance to jet penetration. A first set of shaped charges is oriented to have discharge ends aligned with the first set of the jet target regions 42 and a second set of shaped charges is oriented to have discharge ends aligned with the second set of the jet target regions 44 such that firing the first set of shaped charges creates perforations 46 having a first penetration profile and firing the second set of shaped charges creates perforations 48 having a second penetration profile that is different from the first penetration profile. In the illustrated embodiment, perforations 46 having the first penetration profile are depicted as deep perforations having relatively narrow perforation tunnels and having relatively small entry hole diameters. Perforations 48 having the second penetration profile are depicted as shallow perforations having relatively wide perforation tunnels and having relatively large entry hole diameters. As such, upon detonation, the liners of the shaped charges form jets that pass through target regions 42, 44, casing 34, cement 36 and a depth into formation 14 forming perforations 46, 48 having variable penetration profiles.

Even though FIG. 1 depicts the present invention in a vertical wellbore, it should be understood by those skilled in the art that the present invention is equally well suited for use in wellbores having other directional configurations including horizontal wellbores, deviated wellbores, slanted wellbores, lateral wellbores and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts the present invention in an offshore operation, it should be understood by those skilled in the art that the present invention is equally well suited for use in onshore operations.

Figure 2:
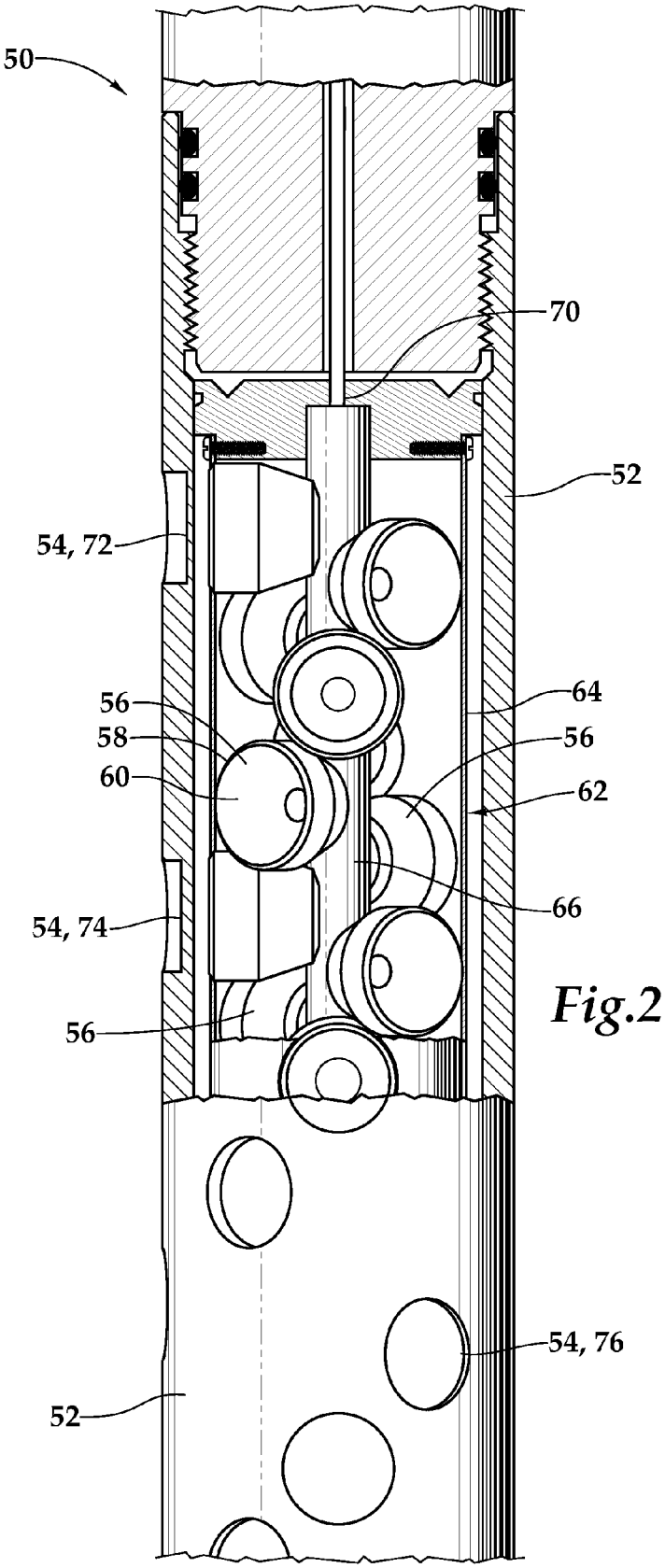
FIG. 2 is partial cut away view of a perforating gun apparatus according to an embodiment of the present invention.

Referring now to FIG. 2, therein is depicted a shaped charge perforating gun apparatus of the present invention that is generally designated 50. Perforating gun apparatus 50 includes a carrier gun body 52 made of a cylindrical sleeve preferably formed from steel having a plurality of radially reduced areas depicted as scallops or recesses 54 that form the jet target regions of perforating gun apparatus 50. Radially aligned with each of the recesses 54 is a respective one of a plurality of shaped charges 56. Each of the shaped charges 56 includes an outer housing, such as housing 58, and a liner, such as liner 60. Disposed between each housing and liner is a quantity of high explosive.

The shaped charges 56 are retained within carrier gun body 52 by a charge holder 62 which, in the illustrated embodiment, includes an outer charge holder sleeve 64 and an inner charge holder sleeve 66. In this configuration, outer tube 64 supports the discharge ends of shaped charges 56, while inner tube 66 supports the initiation ends of shaped charges 56. Disposed within inner tube 66 is a detonator cord 70, such as a Primacord, which is used to detonate shaped charges 56. In the illustrated embodiment, the initiation ends of shaped charges 56 extend across the central longitudinal axis of perforating apparatus 50 allowing detonator cord 70 to connect to the high explosive within shaped charges 56 through an aperture defined at the apex of the housings of shaped charges 56.

Each of the shaped charges 56 is longitudinally and radially aligned with one of the recesses 54 in carrier gun body 52 when perforating apparatus 50 is fully assembled. In the illustrated embodiment, shaped charges 56 are arranged in a spiral pattern such that each shaped charge 56 is disposed on its own level or height. It should be understood by those skilled in the art, however, that alternate arrangements of shaped charges may be used, including cluster type designs wherein more than one shaped charge is at the same level, without departing from the principles of the present invention. As discussed below, various set of the recesses 54 of perforating gun apparatus 50 have different characteristics enabling substantially identical shaped charges 56 to create variable penetration profiles upon detonation. For example, in the illustrated embodiment, shaped charges 56 in an upper set of seven are each aligned with recesses 72 having a first depth (one being visible in FIG. 2). Shaped charges 56 in the next set of seven are each aligned with recesses 74 having a second depth (three being visible in FIG. 2). Shaped charges 56 in the lower set of seven (not visible in FIG. 2) are each aligned with recesses 76 having a third depth (four being visible in FIG. 2).

Due to the different depths of recesses 72, 74, 76, a different resistance through carrier gun body 52 is experienced by the various sets of shaped charges 56, respectively aligned with recesses 72, 74, 76. Due to the different resistance, shaped charges 56 aligned with recesses 72 will create different penetration profiles upon detonation than shaped charges 56 aligned with recesses 74. Likewise, shaped charges 56 aligned with recesses 74 will create different penetration profiles upon detonation than shaped charges 56 aligned with recesses 76. In addition, shaped charges 56 aligned with recesses 72 will create different penetration profiles upon detonation than shaped charges 56 aligned with recesses 76. For example, as shaped charges 56 aligned with recesses 72 encounter the thinnest target region, the perforations created therefrom will penetrate the greatest depth into the formation. Similarly, as shaped charges 56 aligned with recesses 74 encounter a thicker target region, the perforations created therefrom will penetrate to a lesser depth into the formation. Further, as shaped charges 56 aligned with recesses 76 encounter the thickest target region, the perforations created therefrom will penetrate the least depth into the formation. As such, perforating gun apparatus 50 of the present invention is operable to generate perforations having variable penetration profiles.

Figure 3:
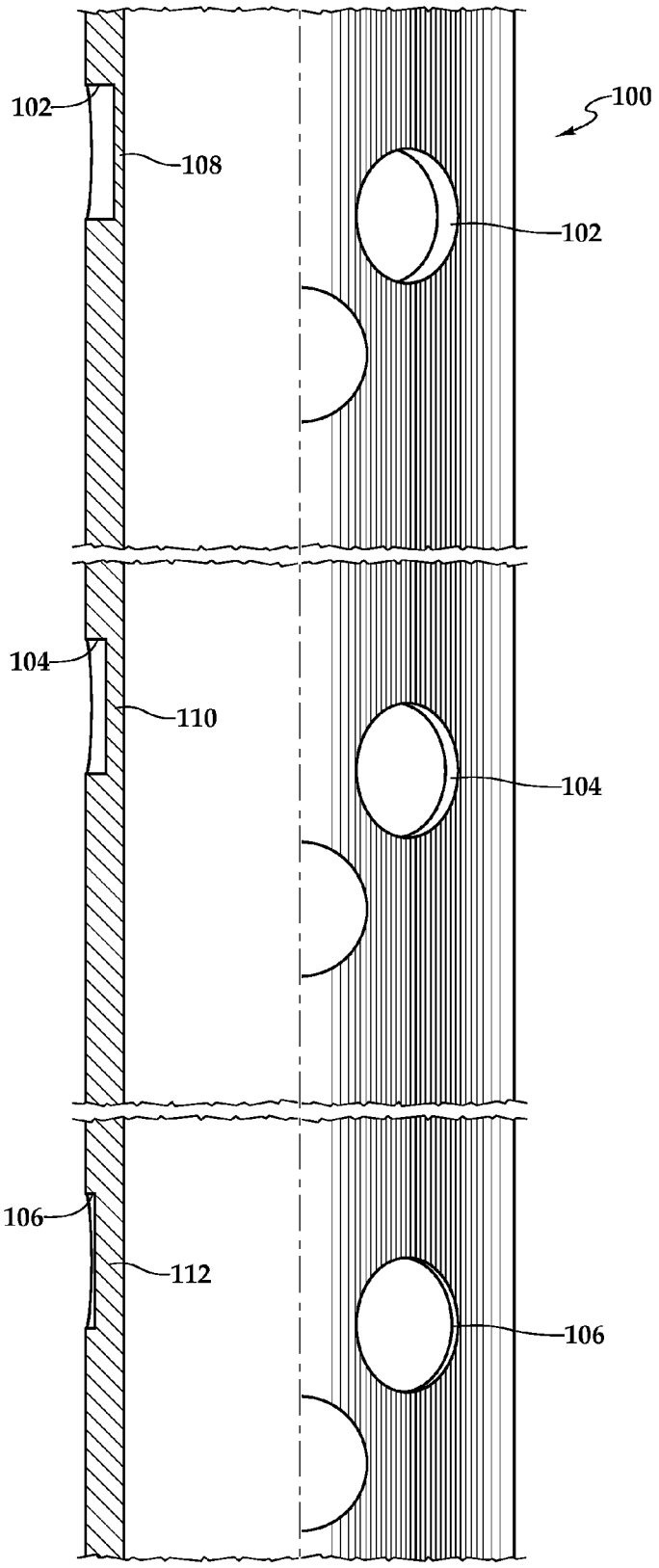
FIG. 3 is a quarter sectional view of a carrier gun body for use in a perforating gun apparatus according to an embodiment of the present invention.

Referring now to FIG. 3, therein is depicted a quarter sectional view of a carrier gun body for a perforating gun apparatus of the present invention that is generally designated 100. Carrier gun body 100 includes a plurality of jet target regions depicted as recesses 102, recesses 104 and recesses 106, three each are visible in FIG. 3. In the illustrated embodiment, recesses 102 have different depths than recesses 104, recesses 104 have different depths than recesses 106 and recesses 102 have different depths than recesses 106. In other words, the wall sections 108, 110, 112 behind recesses 102, 104, 106, respectively, have different thicknesses. Due to the different thicknesses of wall sections 108, 110, 112, the resistance through carrier gun body 100 experienced by shaped charges aligned with wall sections 108, 110, 112 is different. Due to the different resistance, shaped charges aligned with wall sections 108 will create different penetration profiles upon detonation than shaped charges aligned with wall sections 110. Likewise, shaped charges aligned with wall sections 110 will create different penetration profiles upon detonation than shaped charges aligned with wall sections 112. In addition, shaped charges aligned with wall sections 108 will create different penetration profiles upon detonation than shaped charges aligned with wall sections 112.

For example, as the shaped charges aligned with wall sections 108 encounter the thinnest target region, the perforations created therefrom will penetrate the greatest depth into the formation. Similarly, as the shaped charges aligned with wall sections 110 encounter a thicker target region, the perforations created therefrom will penetrate to a lesser depth into the formation. Further, as the shaped charges aligned with wall sections 112 encounter the thickest target region, the perforations created therefrom will penetrate the least depth into the formation. As such, perforating gun apparatus 100 of the present invention is operable to generate perforations having variable penetration profiles. As depicted in FIG. 3, the depth of recesses 104 is about 100 percent greater than the depth of recesses 106, the depth of recesses 102 is about 50 percent greater than the depth of recesses 104 and the depth of recesses 102 is about 200 percent greater than the depth of recesses 106.

Even though recesses 102, 104, 106 of carrier gun body 100 have been depicted and described as having particular depths and particular depths compared to one another, it should be understood by those skilled in the art that recesses having other depths and other depths compared to other recesses are possible and are considered to be within the scope of the present invention. For example, certain recesses in a carrier gun body 100 of the present invention may be described as having a first depth while other recesses in a carrier gun body 100 of the present invention may be described as having a second depth. Using this nomenclature, the depth comparison of the first depth to the second depth may be greater than 10 percent, greater than 25 percent, greater than 50 percent, greater than 100 percent, greater than 200 percent, greater than 400 percent and the like. What is important is that the difference in the depth of the recesses creates a difference in the resistance experienced by the jets created upon detonation of shaped charges aligned therewith, which results in different penetration profiles. Even though FIG. 3 has described all of the jet target regions as including a recess, those skilled in the art should recognize that certain of the jet target regions could alternatively include a slick wall pipe section.

Figure 4:
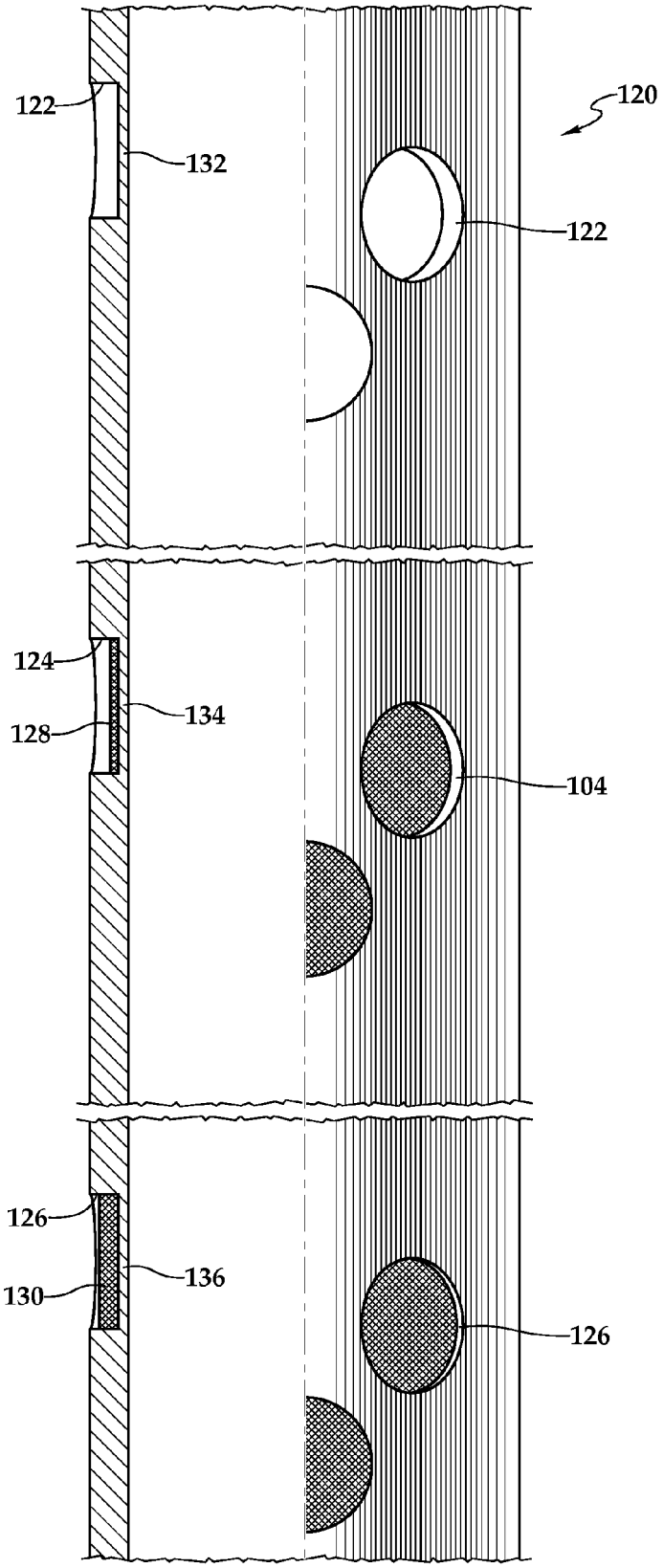
FIG. 4 is a quarter sectional view of a carrier gun body for use in a perforating gun apparatus according to an embodiment of the present invention.

Referring now to FIG. 4, therein is depicted a quarter sectional view of a carrier gun body for a perforating gun apparatus of the present invention that is generally designated 120. Carrier gun body 120 includes a plurality of jet target regions depicted as recesses 122, recesses 124 and recesses 126, three each are visible in FIG. 4. In the illustrated embodiment, recesses 122, 124, 126 each have substantially the same depth. In addition, recesses 122 have no inserts associated therewith, recesses 124 have inserts 128 of a first thickness disposed therein and recesses 126 have inserts 130 of a second thickness disposed therein. As illustrated, the second thickness is about 100 percent greater than the first thickness. As such, the wall sections 132, 134, 136 associated with jet target regions 122, 124, 126, respectively, have different effective thicknesses. Due to the different effective thicknesses of wall sections 132, 134, 136, the resistance through carrier gun body 120 experienced by shaped charges aligned with wall sections 132, 134, 136 is different. Due to the different resistance, shaped charges aligned with wall sections 132 will create different penetration profiles upon detonation than shaped charges aligned with wall sections 134. Likewise, shaped charges aligned with wall sections 134 will create different penetration profiles upon detonation than shaped charges aligned with wall sections 136. In addition, shaped charges aligned with wall sections 132 will create different penetration profiles upon detonation than shaped charges aligned with wall sections 136.

In certain embodiments, the carrier gun body 120 may be formed from conventional steel. Inserts 128, 130 may be formed from any suitable material such as a ceramic material, a carbide material, a metal such as conventional steel, tool steel, titanium or an iron based alloy such as an iron alloyed with one or more alloying constituents selected from the group consisting of boron, carbon, chromium, iron, manganese, molybdenum, nickel, niobium, silicon, tungsten and vanadium. In one example, the weight percents of the alloying constituents are between about 0% and 4% boron, between about 0.1% and 8% carbon, between about 0.5% and 21% chromium, between about 55% and 95% iron, between about 0% and 3% manganese, between about 0.5% and 8% molybdenum, between about 0% and 5% nickel, between about 0% and 4% niobium, between about 0% and 2% silicon, between about 0% and 7% tungsten and between about 0% and 4% vanadium. In certain embodiments, inserts 128, 130 may be formed from a nanostructured material having nanosized features such as nanograined iron alloys including nanograined steels. As used herein, a nanostructured material will include materials having features from 1 to 500 nanometers and more preferably materials having features from 1 to 100 nanometers. Inserts 128, 130 may be coupled to carrier gun body 120 in any suitable manner including threading, brazing, adhering, thermal spraying, welding and the like.

Even though inserts 128, 130 have been depicted and described as having a particular thickness and a particular thickness compared to one another, it should be understood by those skilled in the art that inserts having other thicknesses and other thicknesses compared to other inserts are possible and are considered to be within the scope of the present invention. For example, certain inserts in a carrier gun body 120 of the present invention may be described as having a first thickness while other inserts in a carrier gun body 120 of the present invention may be described as having a second thickness. Using this nomenclature, the thickness comparison of the first thickness to the second thickness may be greater than 10 percent, greater than 25 percent, greater than 50 percent, greater than 100 percent, greater than 200 percent, greater than 400 percent and the like. What is important is that the difference in the thickness of the inserts creates a difference in the resistance experienced by the jets created upon detonation of shaped charges aligned therewith, which results in different penetration profiles.

Figure 5:
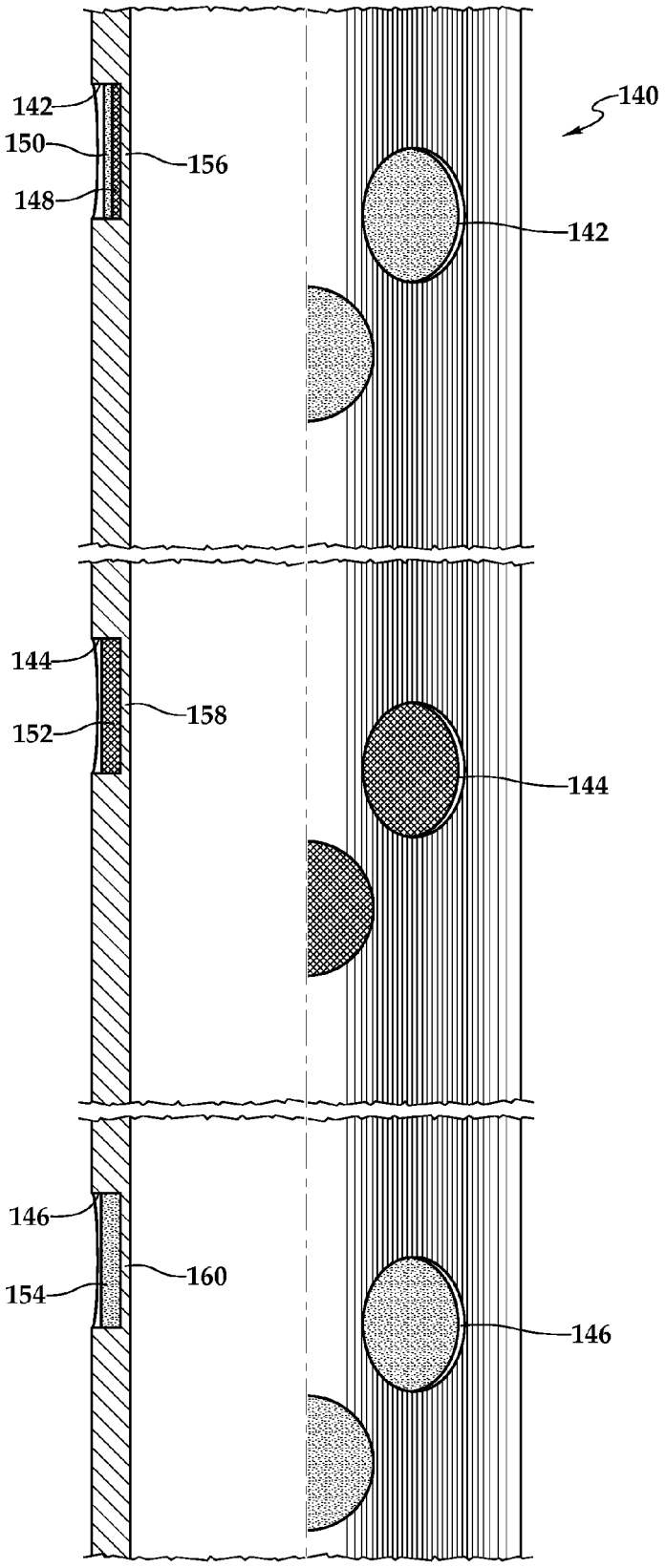
FIG. 5 is a quarter sectional view of a carrier gun body for use in a perforating gun apparatus according to an embodiment of the present invention.

Referring now to FIG. 5, therein is depicted a quarter sectional view of a carrier gun body for a perforating gun apparatus of the present invention that is generally designated 140. Carrier gun body 140 includes a plurality of jet target regions depicted as recesses 142, recesses 144 and recesses 146, three each are visible in FIG. 4. In the illustrated embodiment, recesses 142 have first inserts 148 of a first material and second inserts 150 of a second material disposed therein, recesses 144 have inserts 152 of the first material or a third material disposed therein and recesses 146 have inserts 154 of the second material or a fourth material disposed therein. As illustrated, the recesses 142, 144, 146 have substantially the same depth. Also, as illustrated, the thicknesses of inserts 152, 154 as well as the combined thickness of inserts 148, 150 is substantially the same. Accordingly, the thicknesses of wall sections 156, 158, 160 are depicted as being substantially the same. Due to the different materials of inserts 148, 150, 152, 154, however, the resistance through carrier gun body 140 experienced by shaped charges aligned with wall sections 156, 158, 160 is different. Due to the different resistance, shaped charges aligned with wall sections 156 will create different penetration profiles upon detonation than shaped charges aligned with wall sections 158. Likewise, shaped charges aligned with wall sections 158 will create different penetration profiles upon detonation than shaped charges aligned with wall sections 160. In addition, shaped charges aligned with wall sections 156 will create different penetration profiles upon detonation than shaped charges aligned with wall sections 160.

Similar to inserts 128, 130 described above, inserts 148, 150, 152, 154 may be formed from any suitable material such as a ceramic material, a carbide material, a metal such as tool steel, titanium or an iron based alloy such as an iron alloyed with one or more alloying constituents selected from the group consisting of boron, carbon, chromium, iron, manganese, molybdenum, nickel, niobium, silicon, tungsten and vanadium. Also, as with inserts 128, 130 above, inserts 148, 150, 152, 154 may be coupled to carrier gun body 140 in any suitable manner including threading, brazing, adhering, thermal spraying, welding and the like.

Even though inserts 152, 154 and the combination of inserts 148, 150, have been depicted and described as having particular thicknesses and having particular thicknesses compared to one another, it should be understood by those skilled in the art that inserts having other thicknesses and other thicknesses compared to other inserts are possible and are considered to be within the scope of the present invention. What is important is that the difference in the materials of the inserts creates a difference in the resistance experienced by the jets created upon detonation of shaped charges aligned therewith, which results in different penetration profiles.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A perforating gun apparatus comprising:

a carrier gun body having a plurality of jet target regions, a first set of the jet target regions having a first resistance to jet penetration and a second set of the jet target regions having a second resistance to jet penetration that is different than the first resistance;

a charge holder positioned within the carrier gun body; and a plurality of shaped charges supported by the charge holder, a first set of the shaped charges oriented to have discharge ends aligned with the first set of the jet target regions, a second set of the shaped charges oriented to have discharge ends aligned with the second set of the jet target region.

2. The perforating gun apparatus as recited in claim 1 wherein the first set of the jet target regions has recesses of a first depth and the second set of the jet target regions has recesses of a second depth that is different than the first depth.

3. The perforating gun apparatus as recited in claim 2 wherein the first depth is at least 25 percent greater than the second depth.

4. The perforating gun apparatus as recited in claim 2 wherein the first depth is at least 50 percent greater than the second depth.

5. The perforating gun apparatus as recited in claim 1 wherein the first set of the jet target regions has recesses including an insert of a first thickness and the second set of the jet target regions has recesses including an insert of a second thickness.

6. The perforating gun apparatus as recited in claim 5 wherein the first thickness is at least 50 percent greater than the second thickness.

7. The perforating gun apparatus as recited in claim 5 wherein the first thickness is at least 100 percent greater than the second thickness.

8. The perforating gun apparatus as recited in claim 1 wherein the first set of the jet target regions has recesses including an insert of a first material and the second set of the jet target regions has recesses including an insert of a second material.

9. The perforating gun apparatus as recited in claim 8 wherein the first material and the second material are selected from the group consisting of ceramics, carbides, titanium and iron based alloys.

10. The perforating gun apparatus as recited in claim 9 wherein alloying constituents of the iron based alloy are selected from the group consisting of boron, carbon, chromium, manganese, molybdenum, nickel, niobium, silicon, tungsten and vanadium.

11. The perforating gun apparatus as recited in claim 8 wherein the inserts are coupled to the carrier gun body by a process selected from the group consisting of threading, brazing, adhering, thermal spraying and welding.

12. The perforating gun apparatus as recited in claim 1 wherein the first penetration profile includes perforations having a greater depth than the second penetration profile.

13. The perforating gun apparatus as recited in claim 1 wherein the first penetration profile includes perforations having a greater entry hole diameter than the second penetration profile.

14. A perforating gun apparatus comprising:

a carrier gun body having a plurality of jet target regions, a first set of the jet target regions having recesses of a first depth that provide a first resistance to jet penetration and a second set of the jet target regions having recesses of a second depth different than the first depth that provide a second resistance to jet penetration that is different than the first resistance;

a charge holder positioned within the carrier gun body; and a plurality of shaped charges supported by the charge holder, a first set of the shaped charges oriented to have discharge ends aligned with the first set of the jet target regions, a second set of the shaped charges oriented to have discharge ends aligned with the second set of the jet target regions.

15. The perforating gun apparatus as recited in claim 14 wherein the first depth is at least 25 percent greater than the second depth.

16. The perforating gun apparatus as recited in claim 14 wherein the first depth is at least 50 percent greater than the second depth.

17. A perforating gun apparatus comprising: a carrier gun body having a plurality of jet target regions, a first set of the jet target regions having recesses including an insert of a first thickness providing a first resistance to jet penetration and a second set of the jet target regions having recesses including an insert of a second thickness providing a second resistance to jet penetration that is different than the first resistance; a charge holder positioned within the carrier gun body; and a plurality of shaped charges supported by the charge holder, a first set of the shaped charges oriented to have discharge ends aligned with the first set of the jet target regions, a second set of the shaped charges oriented to have discharge ends aligned with the second set of the jet target regions.

18. The perforating gun apparatus as recited in claim 17 wherein the first thickness is at least 50 percent greater than the second thickness.

19. The perforating gun apparatus as recited in claim 17 wherein the first thickness is at least 100 percent greater than the second thickness.

20. A perforating gun apparatus comprising: a carrier gun body having a plurality of jet target regions, a first set of the jet target regions having recesses including an insert of a first material providing a first resistance to jet penetration and a second set of the jet target regions having recesses including an insert of a second material providing a second resistance to jet penetration that is different than the first resistance; a charge holder positioned within the carrier gun body; and a plurality of shaped charges supported by the charge holder, a first set of the shaped charges oriented to have discharge ends aligned with the first set of the jet target regions, a second set of the shaped charges oriented to have discharge ends aligned with the second set of the jet target regions.

21. The perforating gun apparatus as recited in claim 20 wherein the first material and the second material are selected from the group consisting of ceramics, carbides, titanium and iron based alloys.

* * * * *